US006700549B2

(12) United States Patent
Holzman

(10) Patent No.: US 6,700,549 B2
(45) Date of Patent: Mar. 2, 2004

(54) DIELECTRIC-FILLED ANTENNA FEED

(75) Inventor: Eric L. Holzman, Sunderland, MA (US)

(73) Assignee: YDI Wireless, Inc., S. Deerfield, MA (US)

( * ) Notice: Subject to any disclaimer, the term of this patent is extended or adjusted under 35 U.S.C. 154(b) by 0 days.

(21) Appl. No.: 10/097,191

(22) Filed: Mar. 13, 2002

(65) Prior Publication Data

US 2003/0174097 A1 Sep. 18, 2003

(51) Int. Cl.[7] ..... H01Q 13/00
(52) U.S. Cl. ..... 343/772; 343/785; 343/840
(58) Field of Search ..... 343/772, 840, 343/775, 781 R, 785

(56) References Cited

U.S. PATENT DOCUMENTS 4,658,258 A 4/1987 Wilson
5,248,987 A * 9/1993 Lee ..... 343/785
5,455,589 A 10/1995 Huguenin et al.
5,680,139 A 10/1997 Huguenin et al.
5,883,604 A 3/1999 Nicely
6,121,939 A * 9/2000 Imaizumi et al. ..... 343/840
6,163,231 A 12/2000 Phaneuf
6,211,842 B1 * 4/2001 Cousin et al. ..... 343/840

* cited by examiner

*Primary Examiner*—Hoanganh Le
(74) *Attorney, Agent, or Firm*—Hamilton, Brook, Smith & Reynolds, P.C.

(57) ABSTRACT

A dielectric fill disposed in a waveguide is used to form an antenna feed. One attribute of the dielectric fill is to enable a reduction in aperture size that in turn increases the beamwidth. More specifically, an RF signal received or transmitted at the end of the waveguide can have a wider half-power beamwidth angle than otherwise achieved without the dielectric filling the waveguide. A portion of the dielectric fill may protrude beyond the end of the waveguide to match the waveguide to free space. If the waveguide section is cylindrical in cross-section, a transformed section formed of an annular dielectric ring may be used to match the feed to a rectangular waveguide.

31 Claims, 4 Drawing Sheets

DIELECTRIC-FILLED ANTENNA FEED

BACKGROUND OF THE INVENTION

The present invention relates to antenna feeds and, more particularly, millimeter wave frequency feeds adapted for low f/D reflectors.

One type of antenna known as a reflector antenna uses a contoured reflective surface to generate a highly directive far field antenna pattern. A small waveguide aperture feed antenna is typically placed at the focus of the reflector in order to illuminate the same. The desired directivity properties determine the relative dimensions of the reflector. A common parameter describing the geometric properties of a reflector antenna is f/D, which is the ratio of the focal length (f) to the diameter (D). The smaller f/D, the thinner or more compact the reflector antenna assembly can be made.

However, as one decreases f/D, the beamwidth of the illuminating feed must be increased proportionally in order to properly illuminate the reflector surface. For example, it is generally accepted that the reflector surface must receive energy from the feed in such a way that the energy level at the reflector edges is only about 10 decibels (dB) lower than the energy level at the center of the reflector.

One can obtain a broader beamwidth by decreasing the aperture size of the waveguide feed. Fundamentally, the lowest frequency of propagation in such a feed increases with decreasing rectangular waveguide width or circular waveguide diameter. The cutoff frequency of the dominant propagating mode is the waveguide's lowest frequency of operation. In summary, as the feed beamwidth is broadened and the aperture size is decreased, the cutoff frequency of the aperture will increase. Consequently, at a particular frequency, the maximum feed antenna beamwidth is limited, and along with it, the minimum obtainable f/D of the reflector antenna.

In addition, as the desired operating frequency increases into the millimeter-wave range and the aperture size decreases, it becomes difficult to physically machine the aperture and other small structures related to controlling the resulting electromagnetic waves.

SUMMARY OF THE INVENTION

The present invention is an electromagnetic energy feed formed from a section of open-ended, dielectric filled waveguide. The dielectric fill material used is a solid, processable (e.g., machinable), low-loss material that can be shaped as desired.

The dielectric material used to fill the waveguide lowers the cutoff frequency of the dominant electromagnetic mode compared to the same waveguide filled only with air. This allows one to increase the beamwidth when compared to a similar sized, but air-filled only waveguide section.

A broadening of the beamwidth of approximately 10% over an air-filled-only feed has been observed with the propagating mode cutoff frequency set low enough to maintain a good input match. These attributes were achieved for a feed designed to operate in a millimeter wave frequency band at approximately 60 GigaHertz (GHz).

One preferred material for use as the dielectric is Rexolite®. Other suitable materials could be used as long as their properties are stable with temperature and easily processable, i.e., they can be machined or shaped to the desired size to fill the waveguide.

The dielectric filled section is preferably provided as a solid fill of the interior dimension of the waveguide. However, even a partial filling of the waveguide can also be used to provide increased beamwidth.

The preferred embodiment uses a circular-type filled waveguide. However, other waveguide shapes, such as rectangular, may be used as well.

A quarter-wave choke slot may be used to encircle the dielectric-filled waveguide section. The choke slot may be used to match beamwidths in the electrical (E) and magnetic (H) planes. Because the aperture diameter of the dielectric-filled feed is smaller, a ridge between the circular waveguide and the choke slot may be thickened compared to that of an air-filled feed, making the choke slot easier to fabricate for a dielectric-filled feed than for an air-filled feed.

According to other optional aspects of the present invention, a protruding dielectric portion or tip may be used for efficient power transfer at the free space side of the feed. In this arrangement, the tip diameter is chosen to provide maximum power transfer with specific dimensions depending upon the dielectric constant of the dielectric fill. The length of the tip is chosen to be about one-quarter of the wavelength of the expected frequency of operation. In effect, the tip provides a single step, quarter wave transformer to match the feed aperture to free space.

Adaptations may also be made at the waveguide end of the feed. In particular, circular waveguide is not commonly used to construct microwave system components because of its reduced dominant-mode bandwidth compared to rectangular waveguide. Therefore, in a preferred embodiment, the input side of the feed uses a quarter wavelength waveguide transition (e.g., transformer). The transformer matches the field configuration of the circular waveguide used for the feed to the rectangular waveguide used to carry the signal.

In a preferred embodiment, the transformer is an annular ring of dielectric material. In this arrangement, the cross-sectional dimension of the annular ring transformer is chosen depending upon the interior dimension of the rectangular waveguide and the dielectric constant of the feed fill material. The dielectric ring provides an inhomogeneous, quarter wave matching section, functioning much the same as the tip used at the free space end.

It should be understood that the tip at the free space end and the annular ring at the input are specific embodiments of matching sections chosen for ease of machining. They can be interchanged or take other forms in other embodiments. For example, a dielectric tip can be used on the waveguide side, and an annular ring may be used on the free space side.

In a preferred embodiment, metal bosses are placed at the free space end of the waveguide adjacent the protruding tip. The bosses protect the protruding tip, for example, during handling of the feed while manufacturing an antenna assembly. Without the bosses, the protruding tip might otherwise be prone to breakage. The bosses are dimensioned and positioned in such a way that they do not interfere with the electromagnetic radiation properties of the feed.

Finally, the feed may be used with different types of reflectors, including standard parabolic metallic reflectors, transreflectors, and the like.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
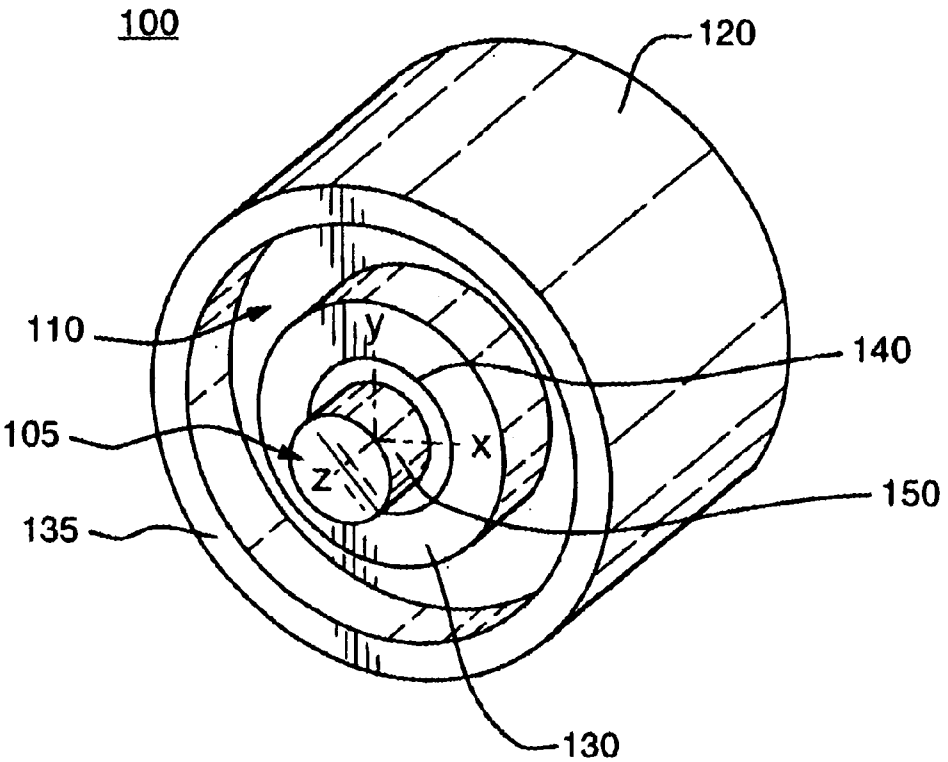
FIG. 1 is a perspective view of an antenna feed according to certain principles of the present invention.

FIG. 1 is a perspective view of a dielectric-filled feed 100 made from a cylindrically shaped housing 120 containing a circular waveguide 140 that is filled with a section of solid dielectric material 150. Typically, the housing 120 is made from solid aluminum plated with gold. However, any suitable conductive material can be used to form the housing 120.

Generally, the solid dielectric material 150 is selected to have an index of refraction of less than 10. In one application, the dielectric material 150 is Rexolite®, preferred for its low-loss. Rexolite is a registered trademark of C-Lec Plastics, Inc. of Beverly, N.J., Rexolite can be easily machined to the general shape of the interior of the waveguide and to provide the structure of the protruding tip 105.

The illustrated embodiment uses a cylindrically shaped housing 120 and waveguide 140. It should be noted, however, that other waveguide shapes can be used, for example, a rectangularly shaped waveguide in a rectangular housing.

Antenna feed 100 can also include a choke for enhancing the proper illumination of a reflector, as will be described below. More specifically, housing 120 can be machined at one end to include a choke slot 110 formed by an outer choke slot ridge 135 and inner choke slot ridge 130. The choke slot 110 is typically a quarter wavelength deep.

A protruding tip 105 is preferably formed as part of the feed from the same dielectric material that is used for the fill 150. For example, a single-piece construction of dielectric material 150 can be machined to form a protruding tip 105 that is smaller in diameter than dielectric 150 filling the waveguide 140. The tip 105 typically protrudes into free space a quarter wavelength beyond the free space end of the waveguide 140.

In one embodiment, the tip 105 is a cylinder extending 45 thousandths of an inch (mils) beyond the end aperture of waveguide 120. In this embodiment, the tip 105 can be machined to a diameter of 57 mils. Based on these dimensions, the antenna feed 100 can generally operate in a millimeter wave frequency range of about 57 to 64 GigaHertz (GHz).

Although the embodiment shown uses a cylindrically shaped protruding tip 105, other shapes such as a rectangular protruding tip 105 can be used according to certain principles of the present invention.

The dielectric-filled waveguide also makes it possible to produce an easier-to-machine inner choke slot ridge 130. More specifically, inner choke slot ridge 130 can now be 30 mils in thickness versus 15 mils that may otherwise be necessary to achieve certain operating characteristics without the dielectric material 150.

A half-power angular beamwidth of one embodiment of the antenna feed 100, including the dielectric material 150 filling and the protruding tip 105, is approximately 68 degrees. Without dielectric material 150 filling waveguide 140, the maximum half-power angular beamwidth is limited by the increasing waveguide cutoff frequency to about 62 degrees. Thus, more than a 10% increase in half-power angular beamwidth is achievable using the techniques according to certain principles of the present invention.

Figure 2:
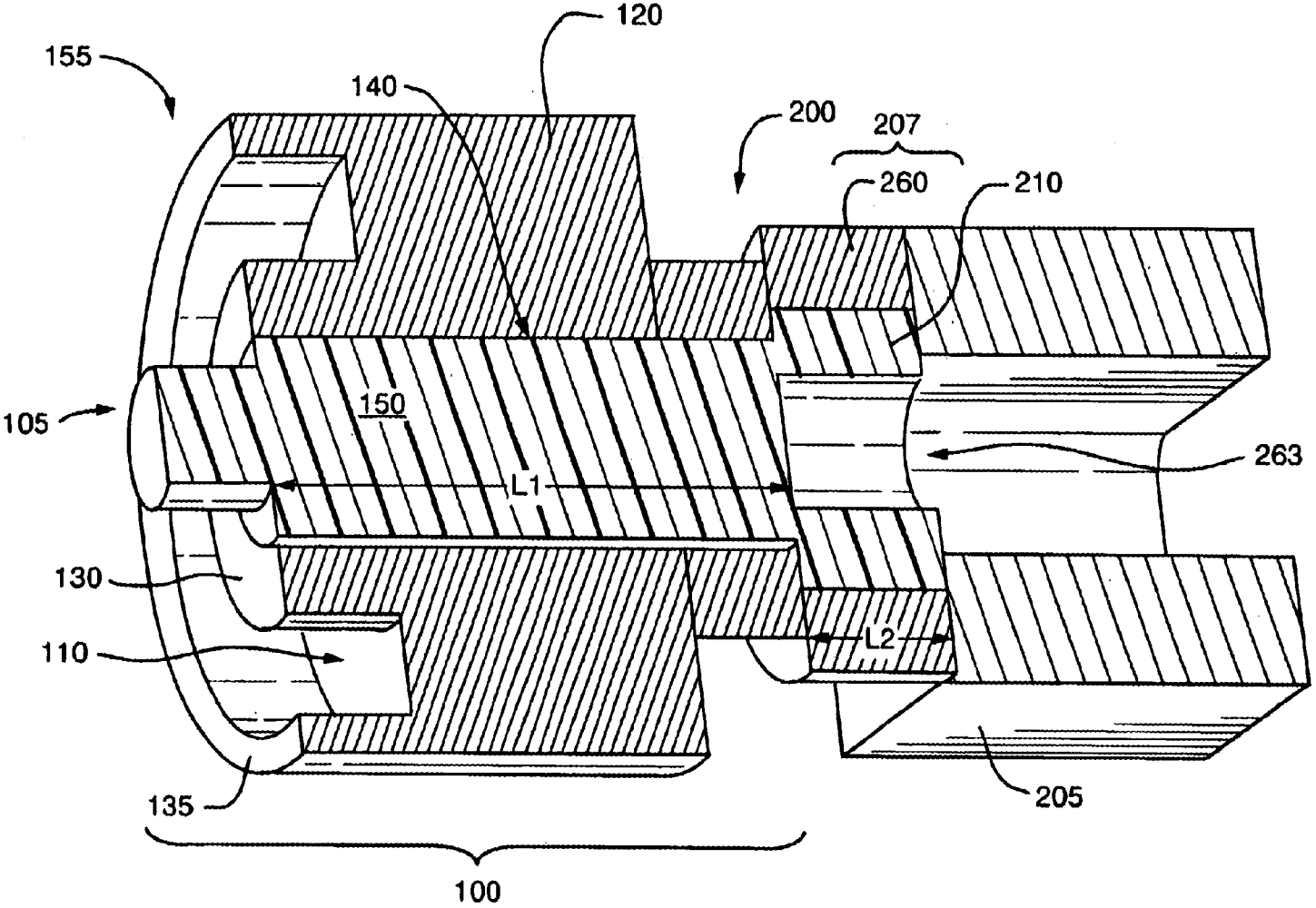
FIG. 2 is a cross-sectional perspective view of the feed.

FIG. 2 is a more detailed cross-sectional view of the feed 100. In a transmit direction, the feed 100 guides microwave energy presented at waveguide end 205 to launch an RF signal into a free space end via protruding tip 105. In a receive direction, RF energy can be received from free space at protruding tip 105 and coupled to waveguide 205.

More particularly, the feed 100 consists of the cylindrical waveguide 140, filled with the dielectric material 150 at a free space end 155. The protruding tip 105 serves as a transformer to efficiently couple electromagnetic energy between free space and the waveguide 140. In addition, choke slot 110 and inner and outer choke slot ridges 130 and 135 are shown in this cross-sectional view, as previously described in connection with FIG. 1.

In this embodiment for operation at approximately 60 GHz, the waveguide section 140 may have an interior diameter of 83 mils and length, $L_1$, of 218 mils.

Choke slot 110 can be 48 mils deep, while outer surface of inner choke slot ridge 130 can be 143 mils in diameter. Consequently, inner choke slot ridge 130 can have a wall thickness of about 30 mils.

In this arrangement, the outer choke slot ridge 135 can have an inner diameter of about 223 mils.

The outer diameter of the various elements of the feed are not as critical, but are preferably as small as possible to keep the cross-sectional area small to minimize reflector blockage.

Also evident in the view of FIG. 2 is the waveguide end 200 of the feed 100 and, in particular, how it couples to a section of waveguide 205. Generally, waveguide 205 may be any suitable microwave system waveguide such as a WR-15 rectangular-type waveguide. The waveguide section 205 may, in a preferred embodiment, be coupled to the feed 100 via a matching section, also called herein a transformer 207.

As shown, the transformer 207 may consist of an annular ring section of dielectric material 210. The properties of the dielectric material section 210 are chosen to act as a transition between the air filled region of the waveguide 205 and the dielectric fill 150 of the waveguide section 140. Specifically, transformer section 207 along a length $L_2$, can be formed as an inhomogeneous, quarter wave matching waveguide section. One particular preferred shape is a ring of dielectric 210 that includes a cylindrically shaped hollow section 263. The hollow section 263 may have a length $L_2$ that is a quarter wavelength long.

The exact shape of the transformer section 207 may be different depending upon different applications. For example, the hollowed section 263 in the dielectric ring 210 may be conically shaped. Other transitional shapes may be possible, such as, for example, providing alternate sections of dielectric and air filled areas within the transition region presented by the transformer 207.

In a transmit direction, where energy flows from a waveguide 205 into free space through the tip 105, the transformer section 207 may be used to ensure that energy is more efficiently coupled through the antenna feed 100 rather than being reflected back into the waveguide 205. In a receive direction, energy received from the free space at the tip 105 is more efficiently coupled into the waveguide 205 through the use of transformer section 207.

In this embodiment, the transformer section 207 may have an inner diameter machined to 105 mils, with the hollow region 263 in the dielectric ring 210 being formed at a diameter of 39 mils and length of 59 mils.

Waveguide 205 can be a standard WR-15 rectangular waveguide having dimensions of 148 mils by 74 mils. The 148 mil width is standard for WR-15 with sharp corners; this width increases to 164 mils when the cross sectional shape has full-radiused ends for ease of machining. Either of the two structures can be used in this invention. Circular, partially circular, elliptical and other shaped waveguides can be used in lieu of rectangular waveguide.

In general therefore, the invention provides a feed as an open ended dielectric filled waveguide 140. In a preferred embodiment, the waveguide section 140 is a circular waveguide operating in the dominant $TE_{11}$ mode. The dielectric 150 is chosen to lower the cutoff frequency of the dominant mode of the waveguide section 140. This permits the electrical size of the aperture of the output and at the free space end 155 to be minimized in size. This, in turn, increases the available beamwidth, as compared to a waveguide section 140 that does not have the filling dielectric 150. The dielectric filling 150 can be partial, but a solid fill is a specific preferred embodiment and is most likely the easiest to machine to the desired dimensions.

Furthermore, the choke slot 110 is dimensioned to equalize E- and H-plane beamwidths. In particular, the choke slot 110 may be chosen to control the resulting beamwidth in the E-plane. This is desirable for optimum illumination of the reflector accompanying the feed as is well known in the art.

In general, the diameter of the tip 105 is chosen to provide a maximum power transfer and will depend upon the dielectric constant of the filling material 150 chosen.

Although the free space to dielectric end 155 uses a tip-type matching section 105 and the feed 100 to waveguide transformer 207 uses an annular ring type matching section 210, it should be understood that different matching sections can be used to serve the same purpose in each of the various positions. For example, a dielectric tip surrounded by air could be used at the waveguide end 200 of the device and, similarly, an annular ring of dielectric can be used at the free space end 155.

Figure 3:
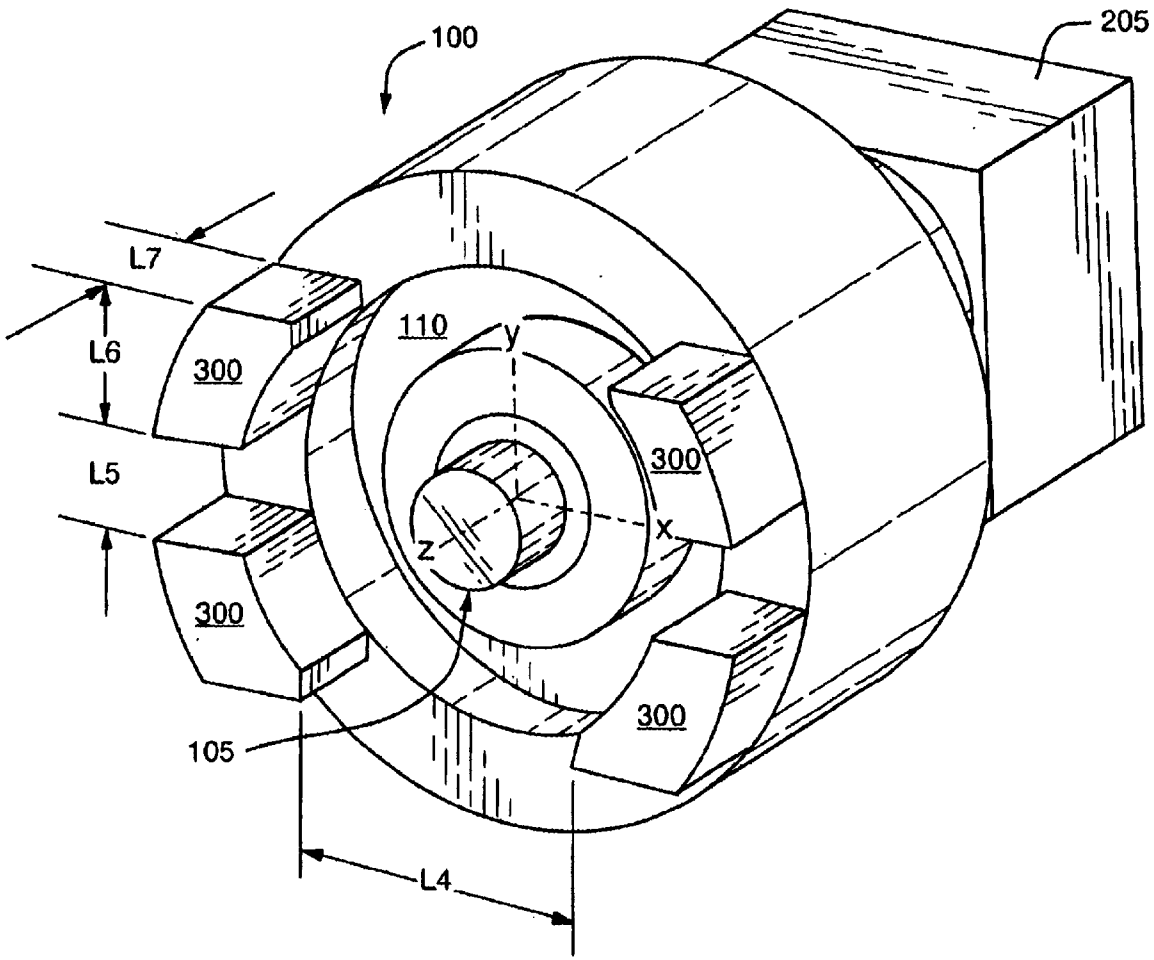
FIG. 3 is a perspective view of an embodiment of the exploded view of an antenna assembly according to certain principles of the present invention.

In practice, we have found it useful to also provide extensions or bosses 300 around the periphery of the tip 105 as best shown in FIG. 3. The bosses 300 prevent damage of the tip 105 during assembly operations for the feed 100.

If the bosses 300 are utilized, one must be careful to ensure that their dimensions and positions are such that they do not interfere with the electromagnetic radiation properties of the feed 100. For example, the bosses 300 should be positioned well clear of the E-plane axis of the feed 100. In the illustrated embodiment for 60 GHz operation, a boss horizontal spacing, $L_4$, of 160 mils, at boss vertical spacing, $L_5$ of 50 mils, at boss vertical dimension $L_6$ of 65 mils, and at boss depth $L_7$ of 65 mils may be used.

The bosses may be manufactured through the addition of simple manufacturing steps during location of the feed 100. In particular, one vertical milling cut and three horizontal milling cuts may be used to form the four bosses 300 from a solid ring of metal surrounding the tip 105 and choke slot 110.

Figure 4:
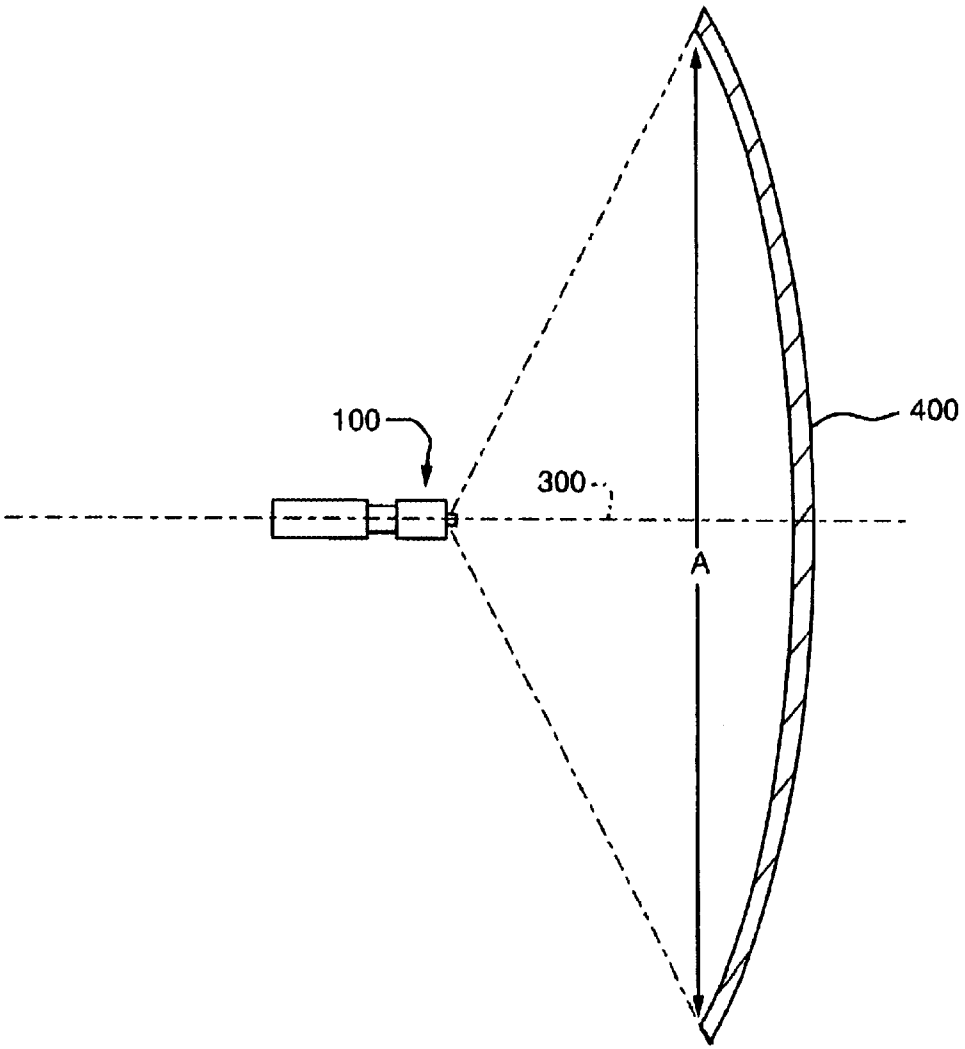
FIG. 4 is a cross-sectional view of the antenna assembly illustrating techniques for producing a collimated output beam according to certain principles of the present invention.

FIG. 4 is a cross-sectional view showing the feed 100 and how it may be used with a reflector 400. As previously mentioned, the antenna feed 100 can be advantageously used in a number of different devices, most particularly antenna devices that use a parabolic reflector to produce a collimated beam of radio frequency energy, transmitting or receiving such a collimated beam.

Reflector 400 may preferably be of a parabolic shape. The parabola has a normal equation which may be represented as $$y=SQRT(4*fx)$$

where SQRT denotes the square root function, f is the desired focal length of the antenna, and x is the direction normal to the reflector plane. That is, x is the distance in the direction of a horizontal line 300 formed between the center line of the feed 100 and reflector 400—and y is in a direction normal to x.

In one application, the reflector 400 is dimensioned to have a diameter, D, such that its aspect ratio f/D is 0.33, and its operating frequency is around 57–64 GHz.

The reflector 400 may be center fed as shown in FIG. 4. However, other uses of the feed 100 are possible. For example, the reflector 400 may be a type of transreflector that actually consists of a thermoplastic dome having a parallel wire grating formed thereon. Such a transreflector is shown in U.S. Pat. Nos. 6,246,381 and 6,006,419, each of which are assigned to Telaxis Communications Corporation, the assignee of the present invention.

It should be understood that other configurations of the feed 100 and reflector 400 are possible. For example, the feed 100 may be used in an off axis feed arrangement whereby the feed is not aligned along the same center axis 300 of the reflector as shown in FIG. 4.

While this invention has been particularly shown and described with references to preferred embodiments thereof, it will be understood by those skilled in the art that various changes in form and details may be made therein without departing from the scope of the invention encompassed by the appended claims.

What is claimed is:

1. An apparatus for feeding electromagnetic energy, the apparatus comprising:

a waveguide for carrying electromagnetic energy;

an aperture located at an exit end of the waveguide, the aperture for producing electromagnetic enemy in the form of an electric (E) field and a magnetic (H) field, with at least one dimension of the aperture being chosen to correspond to a desired beamwidth for one of the resulting E- or H-fields;

a dielectric fill section within the waveguide, with electromagnetic propagation properties of the dielectric fill section being chosen according to a desired cutoff frequency of the electromagnetic energy radiated by the feed;

an input waveguide section, for carrying electromagnetic energy to the feed; and an input transformer, coupled to an end of the waveguide in the feed opposite the exit end, the input transformer for matching the electromagnetic properties of the dielectric section of the feed to that of the input waveguide.

2. The apparatus of claim 1 wherein the dielectric fill section is disposed at the exit end of the waveguide.

3. The apparatus of claim 1 wherein the waveguide has a cylindrical cross-sectional shape.

4. The apparatus of claim 1 wherein the dielectric fill section has a dielectric constant of about 2.5.

5. The apparatus of claim 1 wherein the dielectric fill is selected from a manufacturing processable material.

6. The apparatus of claim 1 wherein the dielectric fill section is formed of Rexolite®.

7. The apparatus of claim 1 additionally comprising:

a choke slot located adjacent the aperture, the choke slot being dimensioned to adjust radiation properties of the radiated E-field.

8. The apparatus of claim 7 wherein the choke slot is dimensioned and positioned relative to the aperture to control a radiated beamwidth of the E-field so that it matches a radiated beamwidth of the H-field.

9. The apparatus of claim 7 where the waveguide has a cylindrical cross-sectional shape and the choke slot is formed as an outer circular ring.

10. The apparatus of claim 7 wherein the choke slot is disposed perpendicular to the resulting E-field.

11. The apparatus of claim 1 additionally comprising:

an output transformer, located adjacent the aperture, for matching electromagnetic properties of the dielectric section to that of free air surrounding the feed.

12. The apparatus of claim 11 wherein the output transformer further comprises:

a solid tip extending beyond the aperture, the tip formed of dielectric material.

13. The apparatus of claim 12 wherein the tip extends beyond the aperture approximately one-quarter wavelength of the electromagnetic energy radiated by the feed.

14. The apparatus of claim 12 wherein the tip has a cross-sectional shape that is generally the same as the waveguide.

15. An apparatus as in claim 1 wherein the carrier medium of the input waveguide is free air.

16. An apparatus as in claim 1 wherein the input transformer is a waveguide transition section.

17. An apparatus as in claim 1 wherein the input transformer is a section of dielectric material having a slot formed therein.

18. An apparatus as in claim 1 wherein the electromagnetic properties comprise field configuration.

19. An apparatus as in claim 1 wherein the electromagnetic properties comprise electromagnetic impedance.

20. An apparatus of claim 1 additionally comprising:

a reflector arranged to receive electromagnetic energy from the waveguide.

21. The apparatus of claim 20 wherein the reflector is metallic reflector.

22. The apparatus of claim 20 wherein the reflector has a parabolic shape.

23. The apparatus of claim 20 wherein the reflector is a transreflector.

24. The apparatus of claim 20 wherein the feed is located approximately along a center line of the reflector.

25. The apparatus of claim 20 wherein the feed is offset from a center line of the reflector.

26. The apparatus of claim 20 wherein the aperture dimension is chosen in consideration of a focal length to diameter (f/D) of the reflector.

27. An apparatus for feeding electromagnetic energy, the apparatus comprising:

a waveguide for carrying electromagnetic energy;

an aperture located at an exit end of the waveguide, the aperture for producing electromagnetic energy in the form of an electric (E) field and a magnetic (H) field, with at least one dimension of the aperture being chosen to correspond to a desired beamwidth for one of the resulting E- or H-fields;

a dielectric fill section within the waveguide, with electromagnetic propagation properties of the dielectric fill section being chosen according to a desired cutoff frequency of the electromagnetic energy radiated by the feed;

an output transformer, located adjacent the aperture, for matching electromagnetic properties of the dielectric section to that of free air surrounding the feed wherein the output transformer further comprises:

an annular ring of material extending beyond the aperture, the annular ring formed of dielectric material.

28. The apparatus of claim 27 wherein the matched electromagnetic properties comprise field configuration.

29. The apparatus of claim 27 wherein the matched electromagnetic properties comprise electromagnetic impedance.

30. The apparatus of claim 27 wherein the electromagnetic energy propagates from the feed to the reflector in a millimeter wave frequency band.

31. The apparatus of claim 27 wherein the feed is used with a reflector that has a focal length to diameter (f/D) of less than one-half.

* * * * *

UNITED STATES PATENT AND TRADEMARK OFFICE

CERTIFICATE OF CORRECTION

PATENT NO. : 6,700,549 B2
DATED : March 2, 2004
INVENTOR(S) : Eric L. Holzman

It is certified that error appears in the above-identified patent and that said Letters Patent is hereby corrected as shown below:

Column 6,
Line 43, please delete “enemy” and insert -- energy --.

Signed and Sealed this

Twenty-ninth Day of June, 2004

JON W. DUDAS
*Acting Director of the United States Patent and Trademark Office*